US005167681A

United States Patent [19]

O'Keefe et al.

[11] Patent Number: 5,167,681

[45] Date of Patent: Dec. 1, 1992

[54] AIR FILTRATION UNIT

[75] Inventors: Donald L. O'Keefe, Wyoming; Thomas J. Belka, Jr., Dorr, both of Mich.

[73] Assignee: Clean Rooms International, Inc., Grand Rapids, Mich.

[21] Appl. No.: 720,955

[22] Filed: Jun. 25, 1991

[51] Int. Cl.[5] ..... B01D 46/02

[52] U.S. Cl. ..... 55/385.2; 55/424; 55/426; 55/472; 55/473; 55/521

[58] Field of Search ..... 55/364, 355, 385.2, 55/385.6, 424, 426, 472, 473, DIG. 3, 497, 521

[56] References Cited

U.S. PATENT DOCUMENTS

| | | | |
|---|---|---|---|
| 1,504,136 | 8/1924 | Patterson et al. | 55/364 |
| 3,251,289 | 5/1966 | Mariner | 98/40 |
| 3,363,532 | 1/1968 | Horneff | 98/33 |
| 3,776,121 | 12/1973 | Truhan | 98/33 R |
| 3,780,503 | 12/1973 | Smith | 55/418 |
| 3,824,909 | 7/1974 | Horneff et al. | 98/40 C |
| 4,088,463 | 5/1978 | Smith | 55/480 |
| 4,094,232 | 6/1978 | Howorth | 98/36 |
| 4,217,121 | 8/1980 | Fichter | 55/478 |
| 4,267,769 | 5/1981 | Davis et al. | 98/33 A |
| 4,319,899 | 3/1982 | Marsh | 55/473 X |
| 4,333,750 | 6/1982 | Helmus et al. | 55/259 |
| 4,440,553 | 4/1984 | Helmus et al. | 55/126 |
| 4,548,068 | 10/1985 | Gualtieri et al. | 73/40.7 |
| 4,554,701 | 11/1985 | Van Roait | 55/472 X |
| 4,560,395 | 12/1985 | Davis | 55/276 |
| 4,616,558 | 10/1986 | Ball et al. | 98/40.11 |
| 4,620,869 | 11/1986 | Goossens et al. | 55/385 |
| 4,637,301 | 1/1987 | Shields | 98/115.3 |
| 4,790,863 | 12/1988 | Nobiraki et al. | 55/276 |
| 4,917,713 | 4/1990 | Helmus | 55/385.2 |

OTHER PUBLICATIONS

Comp-Aire Systems, Inc., Advertisement, "Super EconoFlo" Filter Module, Copyright 1989.

*Primary Examiner*—Charles Hart

*Attorney, Agent, or Firm*—Warner, Norcross & Judd

[57] ABSTRACT

A modular, low-profile ceiling air filtration unit is disclosed having a diffuser plate with an unperforated zone along one edge, the remainder of the plate being perforated. A blower in the unit plenum directs air toward the end of the plenum having the unperforated zone. Turbulent air impinging on the housing end wall is prevented from passing through to a filter by the unperforated zone of the diffuser plate.

16 Claims, 2 Drawing Sheets

AIR FILTRATION UNIT

BACKGROUND OF THE INVENTION

1. Field of the Invention

The present invention relates to an air filtration unit and, more particularly, to a low-profile, ceiling mountable module or unit specially and economically constructed to provide a uniform, low-velocity, downward flow of filtered air.

2. Description of the Related Art

In the construction of clean rooms used for the manufacture of electronic components, medical devices, and the like, it is usually necessary to provide a supply of filtered air. The air must not only be clean, but should be provided in a low velocity, downward, generally laminar flow so as not to create turbulent zones within the room and to carry contaminants from the room.

Air filtration units are known in the prior art in which the unit is constructed to be supported within one of the grid openings of a ceiling grid. Such units typically include a housing defining a plenum, an upper air inlet, a blower, and a filter medium at the lower opening of the plenum. Low-profile units have been provided in which the blower is mounted within the plenum.

Whatever the construction of the air filtration unit, it is necessary to reduce any turbulence created by the blower, and to arrange the plenum such that a uniform flow of air through the filter medium is attained. In the past, air filtration units have been constructed with baffle plates or internal passageways intended to direct and distribute the flow of air from the blower to the filter. Such measures have tended to make the filtration units more complicated and expensive. Furthermore, the addition of such internal structures makes it more difficult to minimize the height of the unit.

Accordingly there is an unmet need for a clean room air filtration unit having a minimal height or profile and that is simply and economically constructed.

SUMMARY OF THE INVENTION

The present invention satisfies the aforementioned need by providing an air filtration unit having a diffuser plate disposed between the blower and the filter medium, the diffuser plate having an unperforated zone at one end opposite the blower, the remainder of the diffuser plate being perforated. The blower is situated within the plenum, preferably toward one end of the plenum adjacent the perforated zone. The air outlet of the blower is directed toward a second, opposite end of the plenum. The unperforated zone of the diffuser plate is situated along the second end of the plenum. The flow of air exiting the blower travels across the diffuser plate and impinges on the housing wall at the second end of the plenum. The turbulent region of air at the second end is precluded from entering the filter medium by the unperforated zone of the diffuser plate. Air is allowed to pass through the diffuser plate to the filter medium only at the remainder of the plenum away from the turbulent region. In this manner, a uniform, low-velocity, substantially laminar flow of air is attained without the need for additional baffles or passageways within the plenum.

These and other objects, advantages, and features of the present invention will be more fully understood and appreciated by reference to the written specification and appended drawings.

DESCRIPTION OF THE PREFERRED EMBODIMENT

Figure 1:
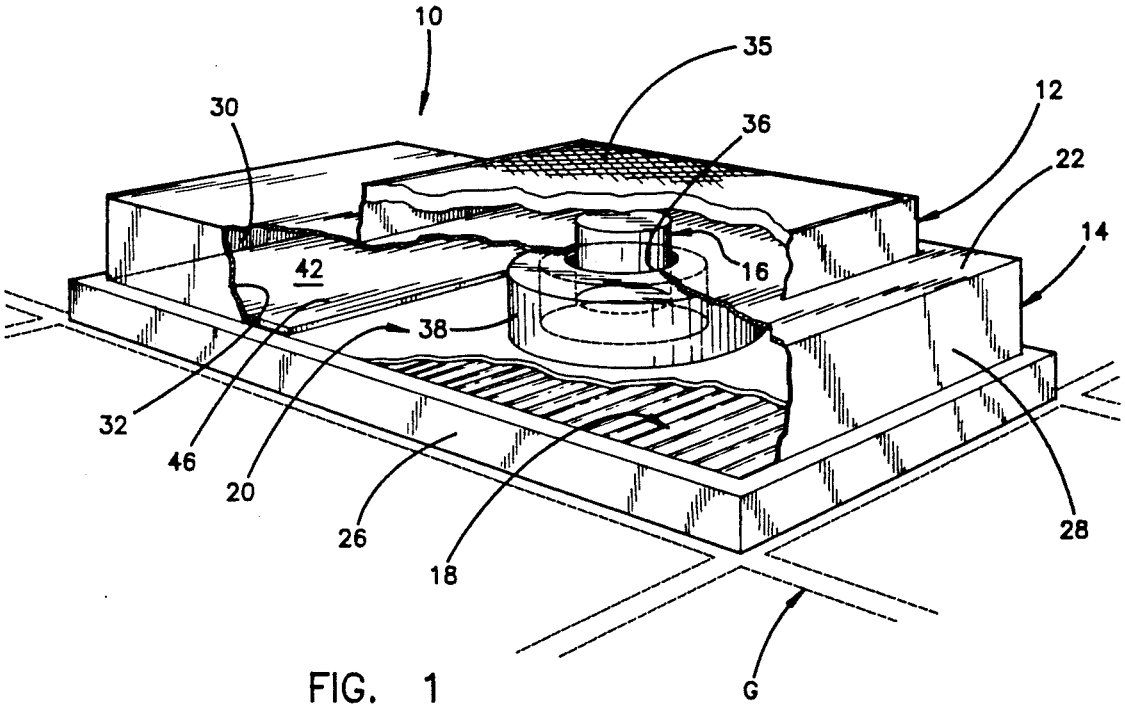
FIG. 1 is a top and side perspective view, with parts broken away, of an air filtration unit according to the principles of the invention.

By way of disclosing a preferred embodiment, and not by way of limitation, there is shown in the figures an air filtration unit 10 which includes in its general organization an air inlet 12, a housing 14, a blower 16, a filter 18, and a diffuser plate 20. Preferably, the filter is a HEPA filter, as is well known in the art. The housing 14, which is generally rectangular in plan, includes an upper portion 22 which defines a plenum 24 and a lower portion 26 suitably configured to receive and retain the filter 18. The housing further includes opposed, spaced-apart first and second end walls 28, 30, side walls 32, 34, and an outlet opening defined by the lower edges of the end and side walls. The diffuser plate 20 is disposed within the outlet opening of the housing between the plenum and the filter medium. The lower portion 26 of the housing is suitably dimensioned and constructed to be supported by a ceiling grid G substantially coextensively with one of the grid openings.

The air inlet 12 includes a grille or prefilter 35 through which air is drawn by the blower 16. In a completed installation, the air inlet 12 will either be connected to suitable ductwork or will draw air from the space above the suspended ceiling. The flow of air passes through an opening 36 of the upper wall to the blower 16. The blower is a centrifugal or squirrel cage type mounted with its axis of rotation substantially normal to the diffuser plate 20. The blower is mounted within the plenum closer to the first end wall 28 than the second end wall 30. The blower 16 includes a blower housing 38 having a blower outlet opening 40 directed generally toward the second end wall 30.

The diffuser plate 20 includes an unperforated zone 42 disposed across an end portion of the diffuser plate adjacent the housing second end wall 30. The remainder of the diffuser plate comprises a perforated zone 44 which is formed with a large number of closely spaced openings through which the flow of air may pass. In the preferred embodiment illustrated in the Figures, the diffuser plate 20 is an assembly of an unperforated plate and a perforated plate which are overlapped as at 46 and joined together by spot welding or other suitable means. Those with ordinary skill in the art will realize that the diffuser plate 20 may also be formed as a unitary plate being solid at one extent and perforated at the other.

Figure 2:
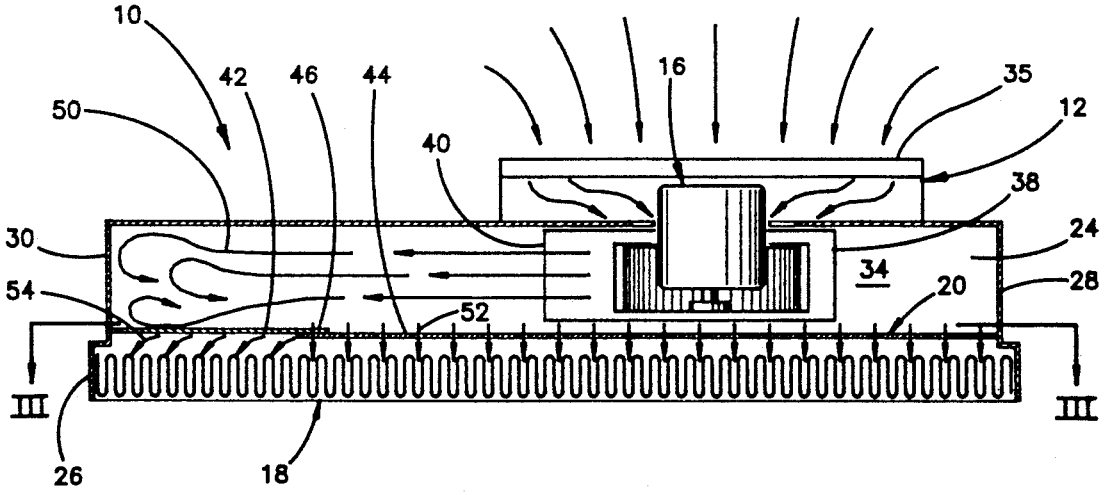
FIG. 2 is a side, elevational, sectional view of the air filtration unit of FIG. 1.
Figure 3:
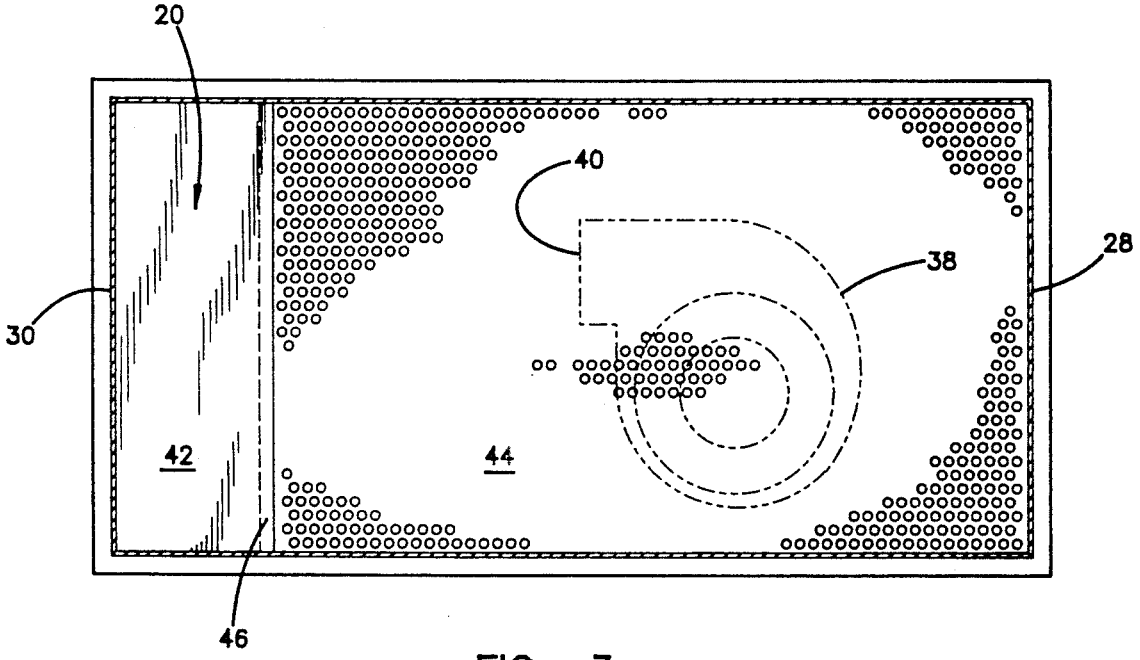
FIG. 3 is a sectional view taken along the line III—III of FIG. 2.

As shown by the air flow lines 50 of FIG. 2, air leaving the blower outlet 40 passes within the plenum across the inner surface of the diffuser plate toward the second end wall 30. A region of turbulence is caused by the air flow impinging on the wall 30. This region of turbulent flow is disposed in the plenum generally adjacent to and coextensive with the unperforated zone 42 of the diffuser plate. In this manner, turbulent air in this region is prevented from passing through the diffuser plate to the filter. Air is able to flow through the diffuser plate only in the region adjacent the perforated zone as indicated by flow lines 52. In this region, the turbulence is much reduced, thus promoting a uniform, more laminar flow of air to the filter.

As shown in FIG. 2, the underside of the diffuser plate 20 is spaced apart a small distance from the upper side of the filter 18. This spacing enables a flow of air to reach under the unperforated zone as indicated by flow arrows 54 and pass through the entirety of the filter.

Preferably the unperforated zone of the diffuser plate will extend over a minor extent of the housing opening, while the perforated zone will extend over the major extent. For an air filtration unit dimensioned to fit within a nominal 2 feet by 4 feet ceiling grid opening, the unperforated zone is preferably approximately 8 inches wide. The diffuser plate is preferably made of 18 gauge metal plate having 5/64 inch diameter holes staggered on 5/32 inch centers. The width of the unperforated zone, as well as the other dimensions of the unit, may easily be modified according to the ceiling configuration, air flow rate, and other pertinent factors.

It should be noted that the plenum is free of any baffles or specially arranged passageways. The plenum need only accommodate the blower, so that the height or profile of the air filtration unit may be minimized.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. An air filtration unit comprising:

a housing defining a plenum having a first end, a second end disposed opposite and spaced apart from said first end, and an outlet opening extending between said first end and said second end;

diffuser means disposed in said outlet opening, said diffuser means having a perforated zone disposed adjacent said first end and formed with a plurality of small, closely-spaced openings, and an unperforated zone disposed adjacent said second end;

blower means for directing a flow of air within said plenum toward said second end.

2. The air filtration unit of claim 1 further comprising air filter means disposed along said diffuser means opposite said plenum.

3. The air filtration unit of claim 1 wherein said blower means is disposed within said plenum.

4. The air filtration unit of claim 1 wherein said blower means is disposed adjacent said perforated zone.

5. An air filtration unit comprising:

a housing including first and second opposed, spaced-apart end walls, first and second side walls, and an outlet opening defined by said walls, said housing defining a plenum;

a diffuser plate disposed in said outlet opening and formed with an unperforated zone and a perforated zone having a plurality of small, closely spaced openings, said unperforated zone disposed along said second end wall and said perforated zone disposed along said first end wall; and, blower means for directing a flow of air within said plenum across said diffuser plate toward said second end wall.

6. The air filtration unit of claim 5 wherein said unperforated zone comprises a minor portion of said diffuser plate.

7. The air filtration unit of claim 5 wherein said blower means is disposed within said plenum.

8. The air filtration unit of claim 7 wherein said blower means is disposed adjacent said perforated zone.

9. The air filtration unit of claim 8 wherein said blower means is disposed closer to said first end wall than said second end wall.

10. The air filtration unit of claim 7 wherein said blower means comprises a centrifugal blower having an axis of rotation disposed generally normal to said diffuser plate.

11. The air filtration unit of claim 5 wherein said diffuser plate comprises a unitary plate.

12. The air filtration unit of claim 5 wherein said diffuser plate comprises discrete perforated and unperforated plates joined together.

13. The air filtration unit of claim 5 further comprising a filter means disposed along said diffuser plate opposite said plenum.

14. The air filtration unit of claim 13 wherein said filter means is spaced apart from said diffuser plate.

15. An air filtration unit comprising:

a generally rectangular housing defining a plenum and including first and second spaced-apart end walls, first and second spaced-apart side walls, an air inlet, and an air outlet opening defined by said side walls and end walls;

a diffuser plate disposed within said air outlet opening and including an unperforated zone disposed along said second end wall, the remainder of said diffuser plate being perforated with a plurality of small, closely-spaced openings;

a blower disposed within said plenum for blowing air entering said air inlet into said plenum, said blower having an outlet directing a flow of air toward said second side wall;

a filter disposed along said diffuser plate opposite said plenum;

said unperforated zone of said diffuser plate being disposed generally coextensively with a region of turbulent air in said plenum caused by the impinging of said flow of air on said second end wall, thereby permitting a uniform flow of air through said openings in the remainder of said diffuser plate and thereafter through said filter.

16. The air filtration unit of claim 15 wherein said diffuser plate comprises an assembly of an unperforated plate and a perforated plate joined together along adjacent edge portions thereof.

* * * * *